US008814422B2

(12) United States Patent
Rosengren et al.

(10) Patent No.: US 8,814,422 B2
(45) Date of Patent: Aug. 26, 2014

(54) EDDY CURRENT MOTOR, EDDY CURRENT COUPLING SYSTEM, AND METHOD OF USE

(75) Inventors: Gary W. Rosengren, Brooklyn Park, MN (US); Steve Besser, Montrose, MN (US)

(73) Assignee: Tol-O-Matic, Inc., Hamel, MN (US)

( * ) Notice: Subject to any disclaimer, the term of this patent is extended or adjusted under 35 U.S.C. 154(b) by 130 days.

(21) Appl. No.: 13/109,578

(22) Filed: May 17, 2011

(65) Prior Publication Data

US 2012/0294111 A1 Nov. 22, 2012

(51) Int. Cl.
*B01F 13/08* (2006.01)

(52) U.S. Cl.
USPC ..... 366/274; 366/273

(58) Field of Classification Search
CPC ... B01F 13/0827; B01F 13/0818; B01F 13/08
USPC ..... 366/273, 274, 127
See application file for complete search history.

(56) References Cited

U.S. PATENT DOCUMENTS

| | | | | |
|---|---|---|---|---|
| 2,350,534 | A * | 6/1944 | Rosinger | 366/274 |
| 2,603,676 | A * | 7/1952 | Morrison, Jr. et al. | 366/273 |
| 3,140,079 | A * | 7/1964 | Baermann | 366/274 |
| 3,554,497 | A | 1/1971 | Zipperer | |
| 3,645,506 | A * | 2/1972 | Selesnick | 366/273 |
| 4,209,259 | A * | 6/1980 | Rains et al. | 366/273 |
| 4,836,826 | A * | 6/1989 | Carter | 366/274 |
| 6,517,231 | B1 * | 2/2003 | Biardeau et al. | 366/273 |
| 2007/0263484 | A1 | 11/2007 | Terentiev | |

FOREIGN PATENT DOCUMENTS

| | | | |
|---|---|---|---|
| DE | 2444328 | A1 | 3/1976 |
| DE | 3828110 | A1 | 2/1990 |
| DE | 10025381 | A1 | 12/2001 |

OTHER PUBLICATIONS

International Search Report prepared by European Patent Office in connection with International Patent Application No. PCT/US2012/037954. 4 pages. Mailed Jul. 15, 2013.

* cited by examiner

*Primary Examiner* — Tony G Soohoo
*Assistant Examiner* — Anshu Bhatia
(74) *Attorney, Agent, or Firm* — Dorsey & Whitney LLP

(57) ABSTRACT

The present disclosure relates to an motor that may be used to stir or agitate a material without the drive components of the motor making direct contact with said material. Particularly, the present disclosure relates to an motor and a method of using such to stir or agitate a food material while insulating the drive components of the motor, and preventing them from coming into direct contact with the food material. The present disclosure has particular application to agitation of materials which should not come into direct contact with the drive components for safety or cleanliness purposes, such as ice cream or slushies, as well as materials with which contact is generally discouraged, such as biomedically pure substances or harsh chemicals.

20 Claims, 5 Drawing Sheets

EDDY CURRENT MOTOR, EDDY CURRENT COUPLING SYSTEM, AND METHOD OF USE

FIELD OF THE INVENTION

The present disclosure relates to an motor that may be used to stir or agitate a material without the drive components of the motor making direct contact with said material. The present disclosure has particular application to agitation of materials which desirably should not come into direct contact with the motor for safety, cleanliness, or other insulative purposes.

BACKGROUND OF THE INVENTION

Several businesses such as the food or chemical industries have a need to stir or otherwise agitate a variety of materials. For example, the ice cream and beverage industries require that their products be constantly stirred or mixed prior to dispensing or sale. Other industries also require equipment that can be used for agitation of substances, including practical applications involving biomedical substances or harsh chemicals.

However, although agitation of such substances can be accomplished from a variety of types of agitation or stirring equipment, several problems arise through direct contact between the machinery and the materials to be agitated. Due to the nature of working with complex machinery, there is often the need to clean, service, or otherwise physically access the equipment in use. Unfortunately, any direct access to agitation drive machinery that is in direct contact with a product material carries with it the constant risk of contamination of that material.

This problem is illustrated most obviously by the food industry, where contamination of the food product can result in the food product having to be discarded entirely. For example, certain milk dispensing equipment requires the milk mixture to be constantly agitated at a particular temperature prior to serving. All serving equipment therefore must be completely free from contamination, even if accessed during use. Biomedical applications may also require the absolute purity of all substances involved. Contamination may also result from certain components found in the agitation equipment, such as lubricants or fuel.

Conversely, direct contact between the products and agitation components may also pose a risk to the drive components of the machinery. In the harsh chemical industry, the risk of this type of contact is a particular danger. When harsh chemicals come into direct contact with delicate drive components or other sensitive parts of powered machinery, there is a clear risk of damage to that machinery.

Therefore, a need exists in the art for a versatile agitation device that can efficiently stir or agitate materials without drive components coming into direct contact with those materials.

BRIEF SUMMARY OF THE INVENTION

The present disclosure relates to a motor system. In one embodiment, the motor includes a basin with a pivot member and a material to be agitated. The motor system includes a motor, which has an eddy current magnet rotor, a drive motor for turning said rotor, and one or more eddy current magnets. The motor system also includes a nonferrous metal mixture element, which has a pivot member receiver which sits atop the pivot member. As a result, the metal mixture element does not come into direct contact with the motor. The motor system may further include a controller, which may be attached to the motor.

The present disclosure, in another embodiment, relates to a method for using a motor to agitate foods. The method provides for an agitator basin that has a pivot member, a motor which includes an eddy current magnet rotor, a drive motor for turning said rotor, and one or more eddy current magnets. The method may also includes a nonferrous metal mixture element, and may include a pivot member receiver. The nonferrous metal mixture element does not come into direct contact with the motor. Finally, the method provides for a controller that is coupled to the motor. The assembly is engaged by the motor controller in order to rotate the nonferrous metal mixture element to agitate the food.

The present disclosure, in yet a further embodiment, relates to a coupling system assembly that includes a motor. The motor may have a magnet rotor, a drive motor, and eddy current magnets which line the perimeter of the magnet rotor. The assembly may also includes a container which contains some material to be agitated, a pivot member, and a electrically conductive nonferrous disc on top of the pivot member. The motor is operated through a controller attached to the motor.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the embodiments will be better understood from the following description taken in conjunction with the accompanying Figures, in which:

DETAILED DESCRIPTION

The present disclosure relates to a novel and advantageous motor assembly that may be used to stir or agitate a material without the drive components of the motor making direct contact with that material. Particularly, the present disclosure relates to a motor and eddy current coupling system and a method of using such to stir or agitate a food material while insulating the drive components of the motor, and preventing them from coming into direct contact with the material. The present disclosure has particular application to agitation of any materials which should not come into direct contact with a motor or other foreign objects for safety or cleanliness purposes. This may include food materials such as ice cream, soft drinks, or slushy mixtures, as well as any materials with which contact is generally discouraged, such as biomedically pure substances or hazardous chemicals.

Figure 1:
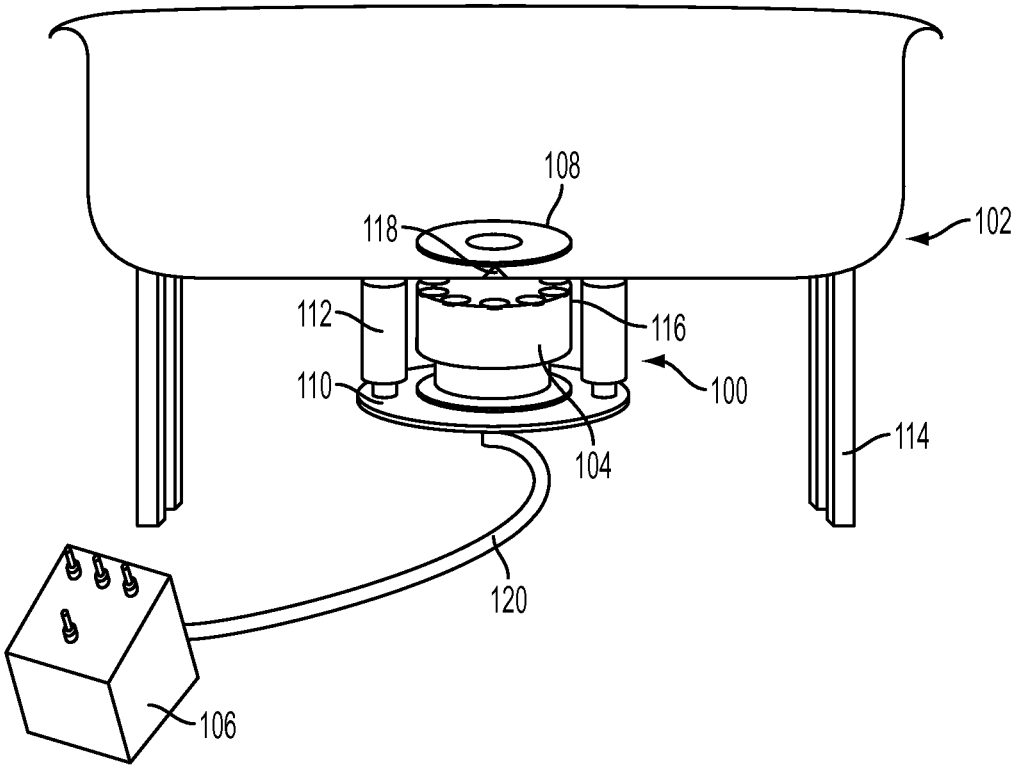
FIG. 1 is a perspective view of an eddy current coupling system, controller, and agitator basin according to one embodiment of the present disclosure.

FIG. 1 illustrates a perspective view of the motor system according to one embodiment of the present disclosure. As can be seen in FIG. 1, an motor assembly 100 may generally include an agitator basin 102, a motor 104, controller electronics 106, and an electrically conductive nonferrous disc 108. According to some embodiments, the motor 104 may be controlled and powered via the controller electronics 106. As motor 104 rotates, it causes electromagnetic eddy currents to form, which are interrupted, for example, by electrically conductive nonferrous disc 108. When the electrically conductive nonferrous disc 108 is subjected to a moving non-uniform magnetic field, an electrical field is induced inside disc 108 causing a force in the same direction as the magnetic field's motion. Thus, disc 108 turns if the rotational force is greater than the frictional drag force. There will be a difference between the speed of the rotating magnets and the speed of the electrically conductive nonferrous disc, referred to as the slip speed. Without slip speed there would be no relative motion between the magnetic field and the electrically conductive nonferrous disc, and thus no force applied. The greater the slip speed the greater the force on the disc, thus the greater the torque delivered to the disc. In other words the slip speed is proportional to the torque delivered to the electrically conductive nonferrous disc. When back EMF is induced it will always tend to resists and/or neutralize the motion/voltage that is creating it. The back EMF force lowers the slip speed.

As a result of the magnetic flux generated by motor 104, and the field interruption of the electrically conductive nonferrous disc 108, disc 108 is caused to rotate in conjunction with the rotation of the motor 104. This activity is discussed in more detail in FIGS. 4 and 5. The electrically conductive nonferrous disc 108 may be located inside agitator basin 102 together with the material to be agitated, such that the base of agitator basin 102 is located between disc 108 and motor 104. Motor 104 may therefore be located outside agitator basin 102. Electrically conductive nonferrous disc 108 may be disposed such that it is generally not in physical contact with motor 104. In some embodiments, electrically conductive nonferrous disc 108 may also take other forms. For example, the geometry of the mixture element may be non-circular, or comprise rotor blades or the like. Additionally, the metal mixture element need not be uniformly nonferrous metal, and may instead take the form of a disc with nonferrous metal segments, channels, or a nonferrous metal ring around the perimeter of the disc.

According to some of the embodiments of the present disclosure, the motor 104 may be fixedly coupled to the underside of agitator basin 102 via motor mount base 110, which may be supported by and fixedly coupled to agitator basin 102 via a plurality of attachment struts 112. Agitator basin 102 may also stand with the support provided by a plurality of agitator basin legs 114. Alternatively, motor 104 may be coupled to a separate support structure and located proximate to the basin 102. With respect to the motor 104, references to the "distal" end of the motor 104 shall refer to the direction towards the electrically conductive nonferrous disc 104, while references to the "proximal" end will mean the opposite direction, towards the motor mount base 110.

According to one embodiment, the motor may be mounted such that the distal end of the motor 104 is substantially parallel to electrically conductive nonferrous disc 108, which may sit upon and rotate about disc pivot member 118. This orientation permits the distal portion of motor 104, which is operably coupled to eddy magnet rotor 116, to come into close general contact with electrically conductive nonferrous disc 108. The distal end of motor 104 may also be so mounted as to decrease or minimize the distance between it and electrically conductive nonferrous disc 108, and therefore increase or maximize the interference between the eddy current field and disc 108. In other embodiments of the present disclosure, a variety of orientations of motor 104 are also possible. This may include orientations such that the motor 104 and electrically conductive nonferrous disc 108 push out or dispense food material, rather than to simply to agitate or stir. Another possibility is to use multiple discrete motors 104 and nonferrous discs 108 together to agitate material within a single agitator basin 102.

The motor 104 may be driven or rotated by a variety of drive mechanisms. In one embodiment, the motor powering and rotating motor 104 may be a stepper-type motor, such as a permanent magnet motor. These motors convert electronic pulses into proportional mechanical movement, and are suited for step-by-step control of rotation. Accordingly, motor 104 may be controlled to rotate at various revolutions per minute (RPM), depending on the settings of controller electronics 106, which may be coupled to motor 104 via control wires 120. Control wires 120 may be operably coupled to motor 104 at its proximal end through or near motor mount base 110. Electrically conductive nonferrous disc 108 may subsequently turn proportionally to the RPMs of motor 104. However, further embodiments of motor 104 may use other electric motors, such as variable-reluctance or hybrid stepper motors, or even non-electrical motors.

Figure 2A:
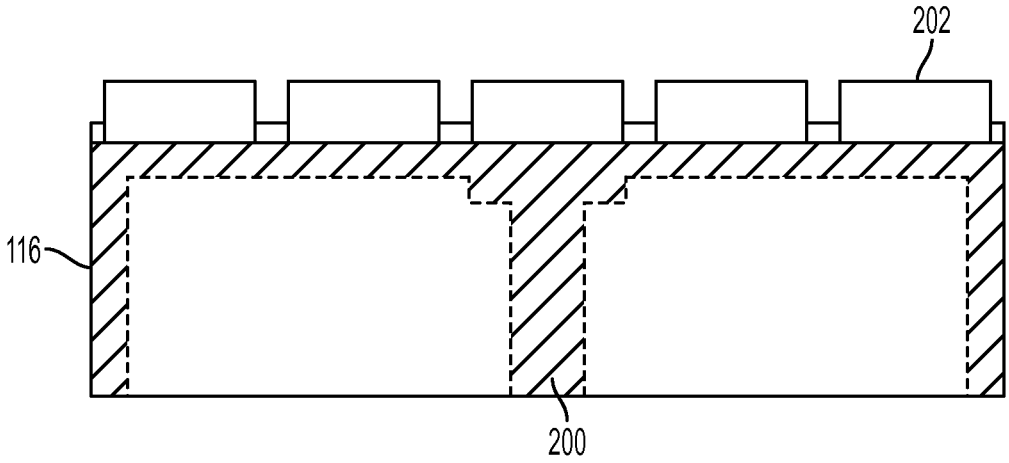
FIG. 2A is a side view cross-sectional diagram of a rotor assembly.
Figure 2B:
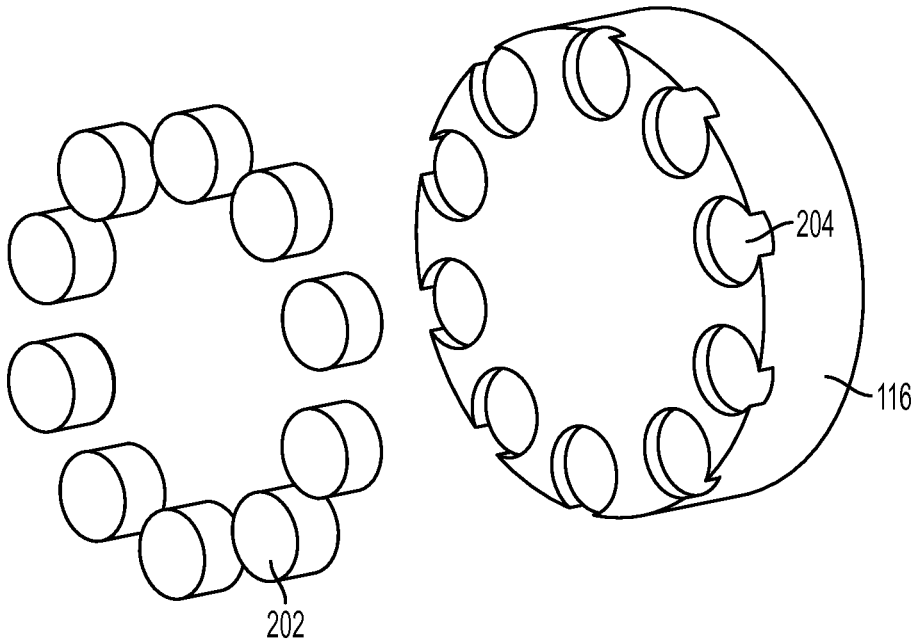
FIG. 2B is an exploded view of the rotor assembly of FIG. 2A.

FIGS. 2A and 2B show a cross-section and an exploded view, respectively, of an embodiment of eddy magnet rotor 116. The eddy magnet rotor 116 may be cylindrically shaped and internally hollowed, and may have of a rotor shaft 200. Eddy magnet rotor 116 may be rotatably coupled to the distal end of motor 104, such as at rotor shaft 200. The rotor shaft 200 may be coupled to motor 104 via screws or another suitable attachment mechanism. In one embodiment rotor shaft 200 may also be supported by bearings at its interface with motor 104. As shown in the illustration, eddy magnet rotor 116 may seat a plurality of eddy current magnets 202 in one of a plurality of matching eddy current magnet indents 204. In one embodiment, there is an even number of eddy current magnets 202 and indents 204. The eddy current magnet indents 204 may serve to anchor each magnet on the rotor, and to provide even spacing and stability to the eddy current rotor 116. Indents 204 may also comprise cylindrical recesses which may partially penetrate the outer edge of eddy magnet rotor 116. There are a variety of possible attachment mechanisms for said the current magnets 202 to rotor 116, such as using an adhesive, or possibly using a simple interference fit into indents 204.

As in the pictured embodiment, eddy current magnets 202 may comprise ten identical magnets, which may be composed of rare-earth neodymium (NdFeB) or N40HT or similar magnetic material. However, it is recognized that any suitable number of eddy current magnets may be used, including greater or fewer than ten. The number of eddy current magnets may, for example, depend on the desired application. Furthermore, eddy current magnets 202 may each be cylindrically shaped, and have a north and south polarity. Each eddy current magnet may be coated with a variety of protective coatings. In one embodiment, the coating may be a black phenolic coating for protection. According to one embodiment of the motor 104, eddy current magnets 202 may be mounted in a radial array along the outer perimeter of the distal end of eddy magnet rotor 116, however other effective locations are possible. For example, eddy current magnets 202 may be arranged to cover the entire surface area of eddy magnet rotor 116.

Figure 3A:
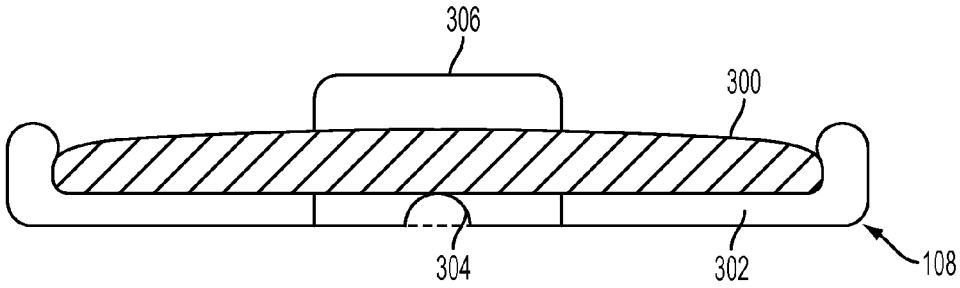
FIG. 3A is a cross-sectional diagram of the electrically conductive nonferrous disc.
Figure 3B:
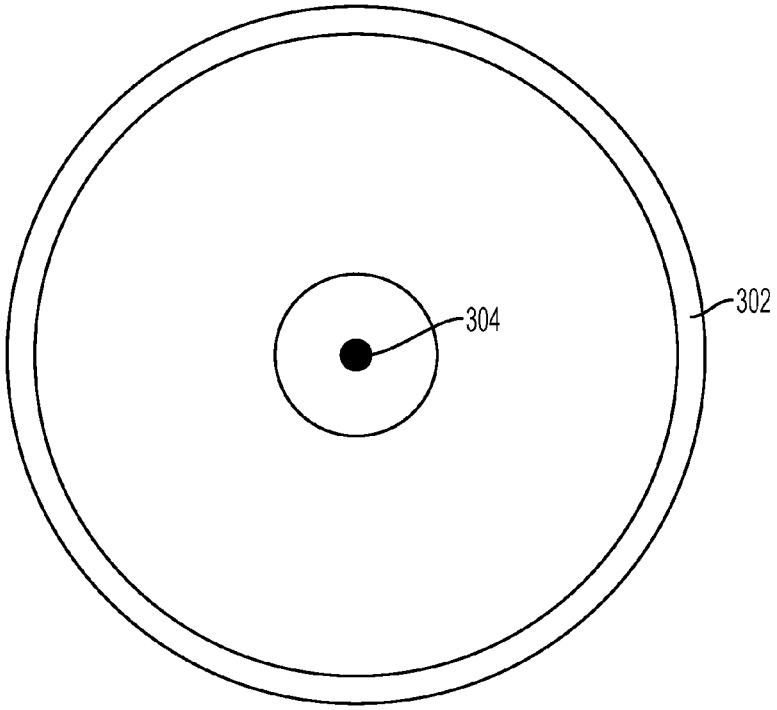
FIG. 3B is a bottom view of the disc of FIG. 3A.

FIGS. 3A and 3B illustrate a cross-sectional diagram and bottom view, respectively, of one embodiment of electrically conductive nonferrous disc 108. Generally, an interference portion 300 of electrically conductive nonferrous disc 108 may be composed of any of a variety of nonferrous metals, including copper or aluminum. Alternatively, interference portion 300 may be composed of any material which sufficiently interrupts the eddy current field generated by motor 104 in order to rotate the disc 108, possibly within agitator basin 102. Disc 108 may also be coated in plastic or another similar insulative material, such that the coating 302 may prevent injury from sharp edges on rotating disc 108, or to better isolate the agitated material from disc 108.

During operation of the motor 104, electrically conductive nonferrous disc 108 may rotate about disc pivot member 118 in response to interference with eddy currents created by motor 116, and may contact pivot member 118 at disc pivot receiver 304. In further embodiments, disc 108 may also be stabilized over pivot member 118 through the use of disc cap 306. Disc cap 306 may also serve the function of adding weight to prevent the disengagement of electrically conductive nonferrous disc 108 from disc pivot member 118 at disc pivot receiver 304. Disc 108 may also be resiliently attached to said disc pivot member 118.

According to other embodiments, electrically conductive nonferrous disc 108 may comprise other shapes or extensions so as to achieve the desired effect with agitated material. This may include the addition of stirring fins, or other extensions designed to further agitate, stir, dispense, or otherwise interact with any target material.

Figure 4:
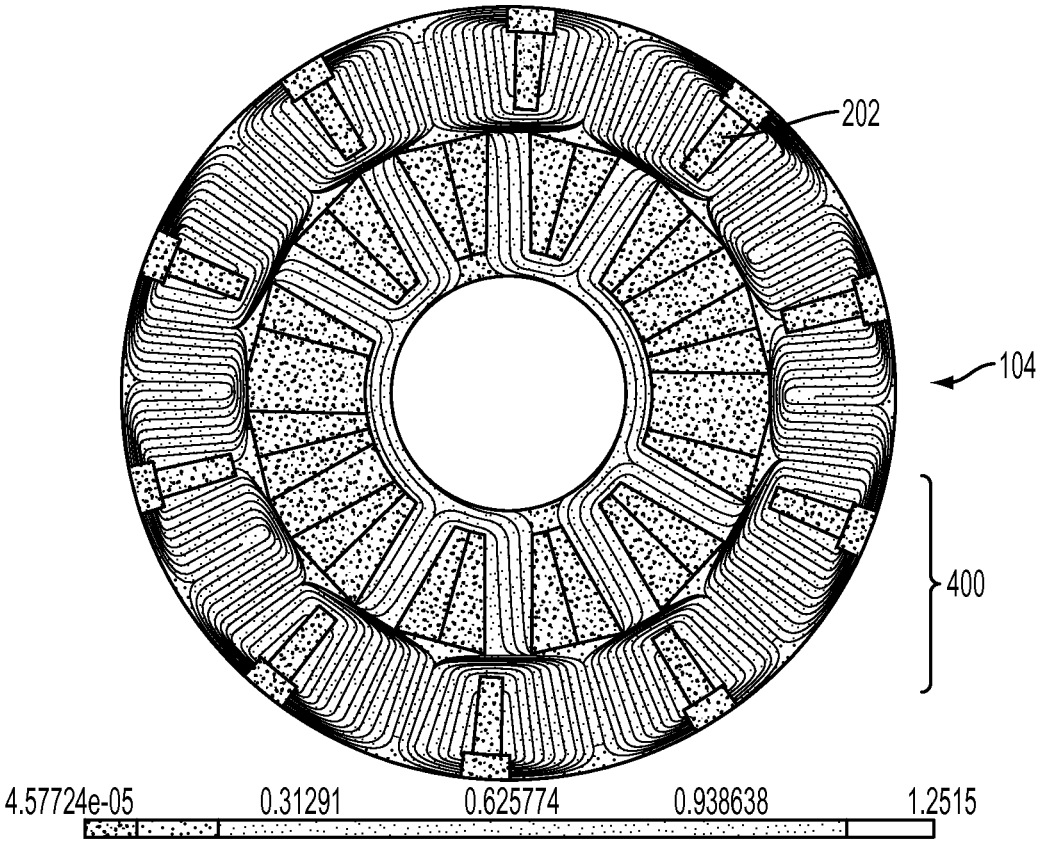
FIG. 4 is a top view flux diagram of eddy currents produced by the motor assembly according to one embodiment.

FIG. 4 depicts a possible flux density diagram of the distal end of motor 104 according to one embodiment of the present disclosure. Swirling eddy current flux 400 is observable around each of the eddy current magnets 202 lining the circumference of motor 104. The flux lines show the approximate locations of where eddy currents may be created in an embodiment of the present disclosure. When the electrically conductive nonferrous disc 108 is moved through a non-uniform magnetic field, the induced electrical field causes a rotational force, thus rotational motion. Therefore, only enough eddy currents sufficient to overcome the frictional drag force are created. The greater the drag, the slower the nonferrous disc turns, the greater the slip speed, and the greater the torque delivered to disc 108.

Figure 5:
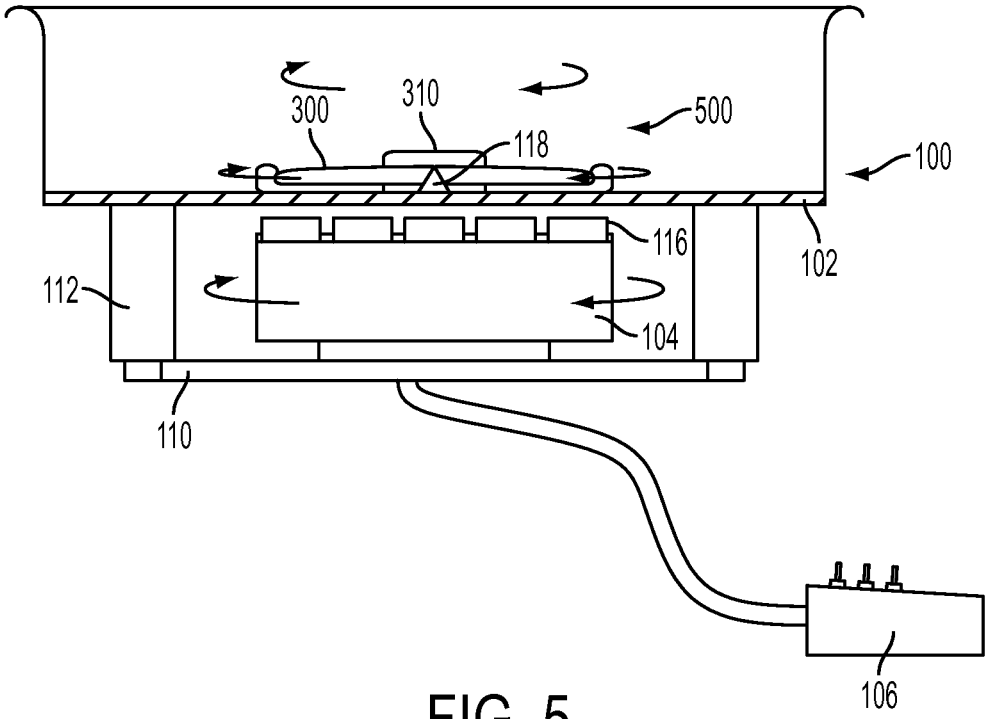
FIG. 5 is a cross-sectional diagram of the motor of FIG. 1 while in use.

FIG. 5 illustrates an embodiment of motor 104 in use. In one embodiment, after basin 102 has been filed with the material 500 to be agitated, operation may begin by engaging controller electronics 106. Controller electronics 106 provides power to motor 104, and may be set to the desired RPMs. As motor 104 causes rotor 116 to rotate, eddy currents 400 are generated, which subsequently interfere with and begin to turn electrically conductive nonferrous disc 108, which may sit upon pivot member 118 through basin 102. As electrically conductive nonferrous disc 108 rotates within basin 102, it agitates the material 500 accordingly. Material 500 may include a variety of food materials, such as milk, ice cream, soft drinks, or a slushy mixture. In contrast, material 500 may also include biomedical substances, hazardous chemicals, or any other material in need of agitation. Agitation speed may be increased or decreased as needed based on the RPM setting applied via controller electronics 106.

The system and methods described above provide various advantages over traditional motors and agitation equipment. Traditionally, eddy currents are considered a negative phenomenon in motors because they tend to be an opposing force which cause energy to be lost. This often results from eddy currents transforming kinetic energy into heat. However, in the present disclosure, eddy currents are utilized to perform beneficial work, such as rotating a disc to agitate various materials. Physical separation between motor and disc further permits insulation between the agitated material and the components of the motor. By isolating these two components, cleanliness of both the agitated material and the motor itself can be easily maintained. If cleaning of the stirring disc is required, it can simply be removed from the basin or other container and cleaned, completely independently of the rest of the motor. This benefit is emphasized if the agitated material is caustic or otherwise potentially harmful to the motor. By being physically separated during operation, there is little possibility for the one element to contaminate the other. Furthermore, the separation between the motor and disc may permit removal of the rotor during operation of the device.

Although the various embodiments of the present disclosure have been described with reference to preferred embodiments, persons skilled in the art will recognize that changes may be made in form and detail without departing from the spirit and scope of the present disclosure.

We claim:

1. A motor assembly with eddy current coupling system, comprising:

a basin having a pivot member and containing a material to be agitated;

a motor, comprising an eddy current magnet rotor, a drive motor for rotation of said rotor, and one or more eddy current magnets disposed in said rotor;

a nonferrous electrically conductive metal mixture element comprising a pivot member receiver which is disposed over said pivot member within the basin and does not come into direct contact with said motor, wherein a slip speed is defined by a difference between a rotational speed of the eddy current magnet rotor and the nonferrous electrically conductive metal mixture element; and a controller operably coupled to said motor;

wherein said nonferrous electrically conductive metal mixture element rotates through a non-uniform magnetic field about said pivot member in response to eddy currents generated by the rotation of said eddy current magnet rotor by said motor;

wherein torque delivered to the nonferrous electrically conductive metal mixture element depends on the slip speed; and wherein eddy currents sufficient to overcome frictional drag are created, such that the nonferrous electrically conductive metal mixture element rotates within the basin containing the material to be agitated.

2. The motor assembly of claim 1, wherein the material to be agitated comprises a food product and the slip speed depends upon frictional drag therewith, such that greater frictional drag corresponds to greater slip speed.

3. The motor assembly of claim 1, wherein the material to be agitated comprises a chemical and the torque depends upon frictional drag therewith, such that greater frictional drag corresponds to greater torque.

4. The motor assembly of claim 1, wherein the nonferrous electrically conductive metal mixture element comprises a nonferrous circular disc, and wherein the pivot member receiver is located at the center of said disc.

5. The motor assembly of claim 1, wherein the drive motor comprises a permanent magnet motor and the torque is proportional to the slip speed.

6. The motor assembly of claim 1, wherein the nonferrous electrically conductive metal mixture element comprises at least one of copper, aluminum, or graphite.

7. The motor assembly of claim 1, wherein the nonferrous electrically conductive metal mixture element is resiliently coupled with said disc pivot member.

8. The motor assembly of claim 1, wherein the nonferrous electrically conductive metal mixture element is coated with an insulative material.

9. The motor assembly of claim 1, wherein the one or more eddy current magnets are radially disposed and equally spaced around the perimeter of said eddy current magnet rotor.

10. The motor assembly of claim 1, wherein the motor is coupled to the bottom of the basin and mounted to minimize a distance between the motor and the nonferrous electrically conductive metal mixture element.

11. A method for using the motor assembly with eddy current coupling system of claim 1 to agitate a food material, comprising:

providing the material to be agitated as a food material to be agitated within the basin having the pivot member;

engaging said motor via said controller, wherein said motor rotates said nonferrous electrically conductive metal mixture element within said basin, in response to said eddy currents generated by the rotation of said eddy current magnet rotor; and agitating said food material thereby.

12. The method of claim 11, wherein the nonferrous electrically conductive metal mixture element is disposed upon said pivot member.

13. The method of claim 11, wherein the nonferrous electrically conductive metal mixture element comprises a circular disc, and wherein the pivot member receiver is located at the center of said disc.

14. The method of claim 11, wherein the drive motor comprises a permanent magnet motor.

15. The method of claim 11, wherein the nonferrous electrically conductive metal mixture element comprises copper or aluminum.

16. The method of claim 11, wherein the nonferrous electrically conductive metal mixture element is coated with plastic.

17. A motor assembly, comprising:

a motor, comprising a magnet rotor, a drive motor, and a plurality of eddy current magnets radially disposed upon said magnet rotor;

a container comprising a basin containing material to be agitated, a pivot member, and an electrically conductive nonferrous mixture element disposed upon said pivot member within said basin, wherein a slip speed is defined by a difference between a rotational speed of the magnet rotor and the nonferrous electrically conductive metal mixture element; and a controller operably coupled to said motor;

wherein said nonferrous electrically conductive metal mixture element rotates through a non-uniform magnetic field about said pivot member in response to eddy currents generated by rotation of said eddy current magnet rotor by said motor;

wherein torque delivered to the nonferrous electrically conductive metal mixture element depends on the slip speed; and wherein eddy currents sufficient to overcome frictional drag are created, such that the nonferrous electrically conductive metal mixture element rotates within the basin containing the material to be agitated.

18. The motor assembly of claim 17, wherein the electrically conductive nonferrous electrically conductive metal mixture element is coated in an insulative material.

19. The motor assembly of claim 17, wherein the drive motor comprises a permanent magnet motor and the torque is proportional to the slip speed.

20. The motor assembly of claim 17, wherein the electrically conductive nonferrous mixture element is comprised of copper or aluminum.

* * * * *